US005472293A

United States Patent [19]

Roller

[11] Patent Number: 5,472,293

[45] Date of Patent: Dec. 5, 1995

[54] MULTIPURPOSE AUTOMATIC GATE CONTROL

[76] Inventor: Lenton D. Roller, Rte. 2, Box 74C, Wister, Okla. 74966

[21] Appl. No.: 929,281

[22] Filed: Aug. 11, 1992

[51] Int. Cl.[6] ..... F02B 7/40

[52] U.S. Cl. ..... 405/94; 405/87; 405/92; 60/398

[58] Field of Search ..... 405/92–94, 87, 405/89, 90, 95, 100; 60/398

[56] References Cited

U.S. PATENT DOCUMENTS

| | | | |
|---|---|---|---|
| 648,312 | 4/1900 | Taylor | 405/93 |
| 1,062,364 | 5/1913 | Schneider | 405/94 |
| 1,230,457 | 6/1927 | Bovery | 405/93 |
| 3,293,862 | 12/1966 | Harding | 405/92 X |
| 3,372,549 | 3/1968 | French | 405/92 |
| 5,125,766 | 6/1992 | de Wit | 405/94 |

FOREIGN PATENT DOCUMENTS

| | | | |
|---|---|---|---|
| 0994615 | 2/1983 | U.S.S.R. | 405/93 |

*Primary Examiner*—Dennis L. Taylor

[57] ABSTRACT

A device with a gate release door and other water release openings to attach to the mouth of outlet pipes of flood control structures and similar reservoirs to control the storage and release of water, comprising a gate release door in initial closed position permitting the reservoir to rise during rainfall, above the intake of the stand tower or stand pipe in the reservoir. A float control switch mounted at a predetermined height above the surface of the reservoir, closes as the rising water reaches this maximum level, activating an electric winch, opening the gate release door, permitting the reservoir to return to normal pool level, and continue to serve the primary function of flood control. A pressure control switch mounted on the device, responding to the increasing hydrostatic pressure, provides a dual means to open the gate release door by activating a parallel circuit to the electric winch. The primary mechanical method to assure gate opening is provided by lever arms and computed counterweights exerting torque forces upon the gate release door, which are overcome when the hydrostatic pressure reaches the predetermined level. Multiple outlets provide water under hydrostatic pressure to agriculture/aquaculture uses and to feed a turbine for generation of electrical/mechanical energy. The combined use of the outlet pipes with the drain valve in the stand tower permit high nutrient waters to flow to the agriculture plots establishing a biological/nutrient cycle.

6 Claims, 3 Drawing Sheets

MULTIPURPOSE AUTOMATIC GATE CONTROL

BACKGROUND OF THE INVENTION

This invention relates to a gate control device that provides distribution of water from a reservoir for multiple uses and opens automatically to release excess water when an increase in reservoir level and fluid pressure occurs.

DESCRIPTION OF PRIOR ART

Many thousands of flood control structures and other single purpose dams have been built in the United States, with no means to control the outflow or capture the potential energy available. The typical structure built by the Soil Conservation Service contains a stand tower in the reservoir with a set level for the pool. All excess rainfall and runoff is released through the outlet pipe. In order that these structures serve their single purpose use, no obstruction to this flow is permitted without prior approval. A fundamental requirement for any obstruction or gate is that it must be guaranteed to open when the reservoir level starts to rise. No prior art exists to serve this need.

There are gate valves and controls in pre-engineered dams. These are designed to withstand the water pressures and horizontal thrust.

Water control gates are also available to maintain a certain level in a waterway or to permit flow into a side ditch. Examples are:

| Patent No. | Inventor | Date |
|---|---|---|
| 4,073,147 | Takeshi Nomura | Feb. 14, 1978 |
| 4,606,672 | James R. Lesire | Aug. 19, 1986 |
| 4,505,612 | George W. Shelley, Jr. | Mar. 19, 1985 |

These water gate control systems are not adaptable to control the flow from a reservoir through an outlet pipe to multiple diversions. Furthermore, they do not provide automatic opening by a combination of mechanical and electrical systems in response to pressure changes and multiple sensing controls.

OBJECTS & ADVANTAGES

The main object of this invention is to provide a closure for installation on the outlet pipes of flood control lakes or similar reservoirs to permit the storage of additional water, to automatically release excess water at a predetermined level and to further control the release of these stored waters for beneficial purposes. This invention will be attached to outflow pipes of flood control structures and other dams and reservoirs to provide for the control and multiple use of the impounded waters.

Several specific objects or advantages of the present invention are:

(a) a simple mechanical principle embodied in a lever arm with counterweights and short restraining toes to provide variable moments of force or torque, (b) the toes permit the opening of the gate on the Multipurpose Automatic Gate Control device when the liquid pressure exceeds the computed restraining force created by the counterweights and lever arm, (c) to provide a secondary method to open the gate in response to dual sensing controls, (d) to mechanically combine these opening mechanisms to assure fail-safe operation. If the electrical system fails the lever arm system will always open the gate.

(e) to provide a multipurpose automatic gate control able to withstand the forward thrust of the impounded waters without physical damage to the dam and pipe structure.

(f) to provide controlled water flow with head pressure to develop rotational energy to produce mechanical or electrical power, (g) to provide controlled gravity flow water to irrigation plots, greenhouse(s), aquaculture ponds and other uses, (h) to provide a capability to increase the storage level in a reservoir, thereby increasing the availability of water and potential energy, (i) to provide distribution of high nutrient waters to agricultural plots thereby creating a biological nutrient cycle, (j) to place this multipurpose automatic gate control to use in the controlled release of impounded waters in a storage reservoir.

Additional objects, features and advantages will become more apparent from the following description of the preferred embodiments in conjunction with the accompanying drawings.

SUMMARY

This invention is based upon the need to control and use water contained in the many existing lakes and reservoirs. These waters present an opportunity to use the potential energy created by the head pressures and to further utilize gravity flow water for irrigation and other purposes. Thus this unique invention saves energy and also produces energy.

The preferred embodiment of this Multipurpose Automatic Gate Control device relates to the installation at the outlet of one of the many flood control structures already built or scheduled to be built. This gate control is mounted upon a substantial foundation base capable of withstanding the forward thrust exerted by the retained waters. The lever arms and computed counterweights react to hold the gate closed until the rising waters cause the pressures to increase to the designed limit, at which time the lever arms begin to rise and thus decreases the restraining force on the bottom of the gate. The float control switch in parallel with the pressure control switch activates the electric winch, simultaneously reacting with the rising lever arm causing the gate to rapidly open. During this period of excess water release, water will continue to be available for the turbine and all other uses. As the reservoir recedes, the gate can be manually closed for reaccumulation of stored water. The addition of an automatic closure feature would increase the risk of the gate not opening.

Other installations will use this embodiment or other embodiments as contained in the description. All the gate controls described meet the required criteria to open automatically when a reservoir reaches the designated level. This provides protection to the dam structure and the emergency spillway. This design is simple yet functional and will operate under all extreme weather conditions.

The multipurpose use of many dams and lakes built primarily for flood control has been foreseen by others. The means to attain this vision without hindering their primary purpose has not occurred until now.

DESCRIPTION

Figure 1:
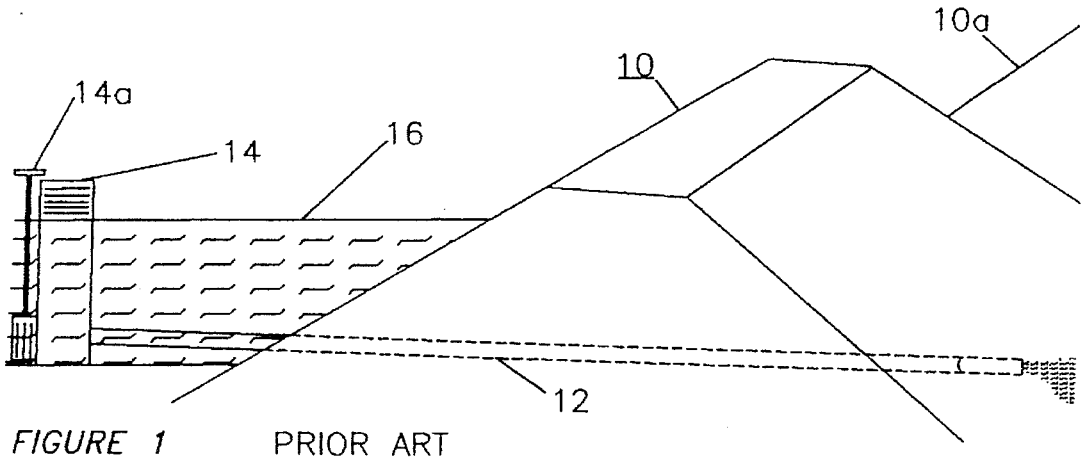
FIGURE 1 PRIOR ART
FIG. 1 Is a schematic presentation of a typical dam, reservoir and outlet pipe with reservoir depth determined by the height of the stand tower.

FIG. 1 is a prior art presentation of a standard design flood control lake and dam with outlet pipe but no means to control water release. A description of these structures is important in order that the reader has a full understanding and appreciation of those and other similar water reservoirs that need to be modified. The earth-filled dam 10 typically spans a valley 90 meters (300 feet) to 300 meters (1000 feet), with a height of 9 meters (30 feet) to 24 meters (80 feet), an emergency spillway 10*a* approximately 2.4 meters (8 feet) lower, and a stand tower 14, approximately 6 meters (20 feet) in height, which controls the reservoir level 16. The tower has a drain valve at the base (14*a*). The outlet pipe 12 varies in diameter from 0.6 meters (2 feet) to 1.8 meters (6 feet). Pipe 12 is made up of sections (not shown) joined together with a slip ring and mastic, and with weep collars spaced at intervals through the dam. This design does not permit excessive tension at the outer end. Over 8000 of these structures have been built throughout the U.S. by the Soil Conservation Service under Public Law 566, and have preformed marvelously for the single purpose of flood control. It is time to obtain additional benefits from these structures by making them multipurpose.

Figure 2:
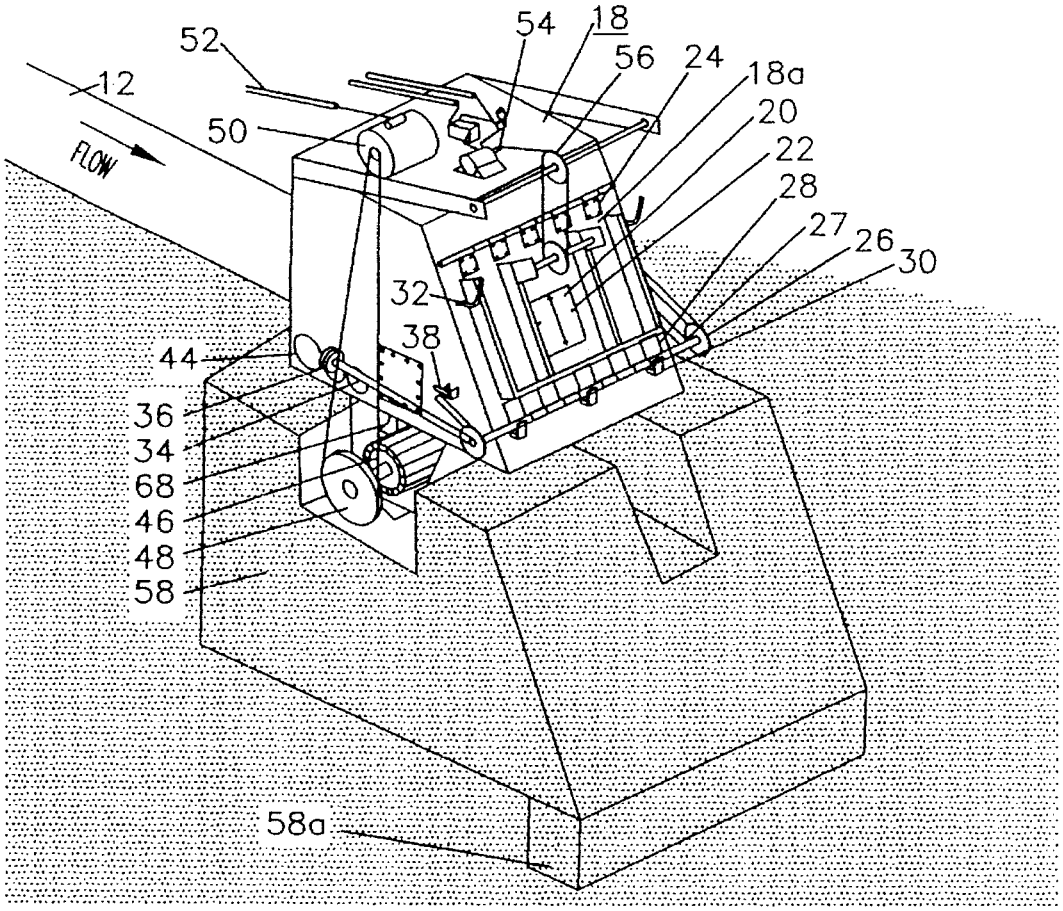
FIG. 2 Shows the Multipurpose Automatic Gate Control device mounted on the foundation support with the gate in closed position and the lever arms and counterweights at maximum torque.

FIG. 2 shows a typical embodiment of the Multipurpose Automatic Gate Control device, made of steel or other materials sufficiently strong to withstand the hydrostatic pressure created by the reservoir head. The gate control device is designed to control the outflow of waters in a reservoir from zero flow to maximum outlet flow. The device has a collar attachment to fit over the outlet pipe to provide a seal and release capability shown in FIG. 7. The outside diameters of outlet pipes vary according to the size of the reservoir and the drainage area above. The collars are designed to fit each outlet pipe and then attached to the gate control device. Materials such as 18 gauge stainless steel are used for durability and provides sufficient flexibility to conform to cable clamp tension, compressing the mastic between the collar and outlet pipe to form a seal. A slippage and release capability exists if excess horizontal forces ever developed, thereby protecting the outlet pipe from separating at a joint inside the dam.

The main components hereinafter described and shown in FIGS. 2 through 10 comprise a unique means to respond to a combination of predetermined hydrostatic pressures and reservoir elevation limits.

(a) Counterweights on the lever arms, which provide fulcrum forces at the base of the gate release door are computed to hold said door closed until the hydrostatic pressure reaches the computed limit. This limit being the pressures created by the height of the surface waters of the reservoir plus approximately 1.2 meters (4 feet) rise for the extra storage capacity. As this limit is approached, the counterweights and lever arms begin to rise above horizontal, reducing the effective lever arm length and likewise the amount of fulcrum force, thus guaranteeing the gate release door to open.

(b) A pressure control switch mounted on the exterior of the gate control device is set to close at the same hydrostatic pressure, actuating a relay (not shown) and permitting current to flow from the first battery to the electric winch. The energized electric winch winds up the cable in communications with a series of pulleys placed for mechanical advantage, and lifts the gate release door.

(c) A float control switch (not shown) set at a height of approximately 1.2 meters (4 feet) above the reservoir surface waters, closes when the rising waters reach the prescribed level, actuating a second relay (not shown) permitting current to flow from the second battery (not shown) through a parallel circuit to the electric winch, which winds up the cable as before.

This redundancy of signal input actuating the electric winch, simultaneous with the decreasing fulcrum forces, guarantees the opening of the gate release door.

(d) This gate release door is hinged with adjustable hinge flaps along the top edge, permitting said door to swing upward and engage the spring gate catches to allow full discharge. The hinge flaps are adjustable by means of spacer washers (not shown) encircling each mounting bolt, and between the outer face of the gate control device and the underside of the hinge flaps, thus permitting a closer spacing upon the removal of the washers, when the mastic seal around the door edge becomes compressed after a period of use.

As shown in FIG. 2, the gate control device 18 has a gate release door 18*a* in closed position. Lever arms 34 and counterweights 36 are in a horizontal position exerting maximum torque on the toes 28, and thus applied to the bottom edge of gate release door 18*a*. A torque shaft 27, mounted on block bearings 26, transfers the rotational force. Gate release door 18*a* is attached to gate control device 18 by adjustable hinge flaps 24 with spacer washers (not shown) to allow for changes in thickness of the gasket seal (not shown). A sliding hatch door 20 with adjustable dogs 22 is mounted on the front of gate release door 18a for partial release of water. A toe stop 30 is mounted in front of each toe 28 to retain lever arms 34 in a vertical position shown in FIGS. 3, 4 and 6 with gate release door 18*a* open. Spring gate catches 32 permit gate release door 18*a* to rise to full open position and then spring back in place to hold gate release door 18*a*. As arm catches 40 rise, they lift a by-pass catch 38 on each side of gate control device 18. A clean-out door 42 is provided. A water outlet 44 for each special use is provided. A cross flow turbine 46, one of several known types, is fed by a thin horizontal sheet of water through a flume 68. A pulley 48 transfers the rotational power developed to a typical generator 50.

Figure 5:
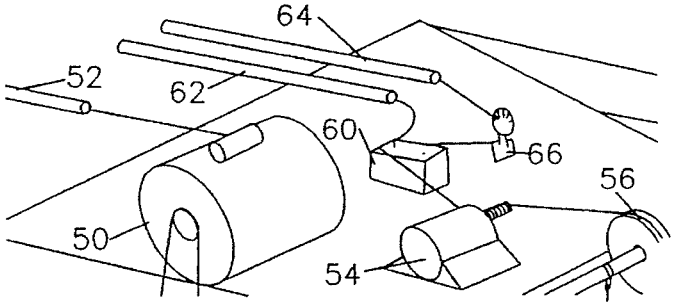
FIG. 5 Is a view in detail of the electrical components.
Figure 6:
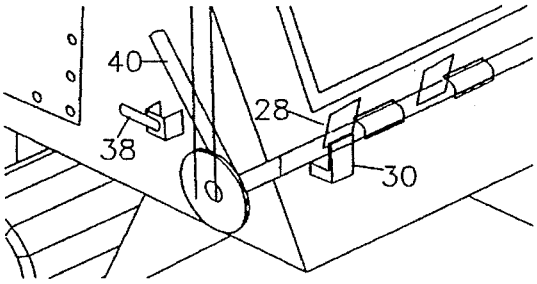
FIG. 6 Shows the by-pass catch and toes.

Electrical components are better illustrated in FIG. 5. A conventional electric winch 54 is connected to a pulley arrangement 56 and is powered by standard batteries 60. An electrical circuit 62 provides charging current. An electric output circuit 52 carries power output from generator 50 to a regulator and distribution panel (not shown). A float control switch (not shown) at the reservoir uses a circuit and relay 64 in parallel with a circuit from the pressure control switch and relay 66 to activate the electric winch. A gauge, also self contained, provides visual pressure readings.

Figure 3:
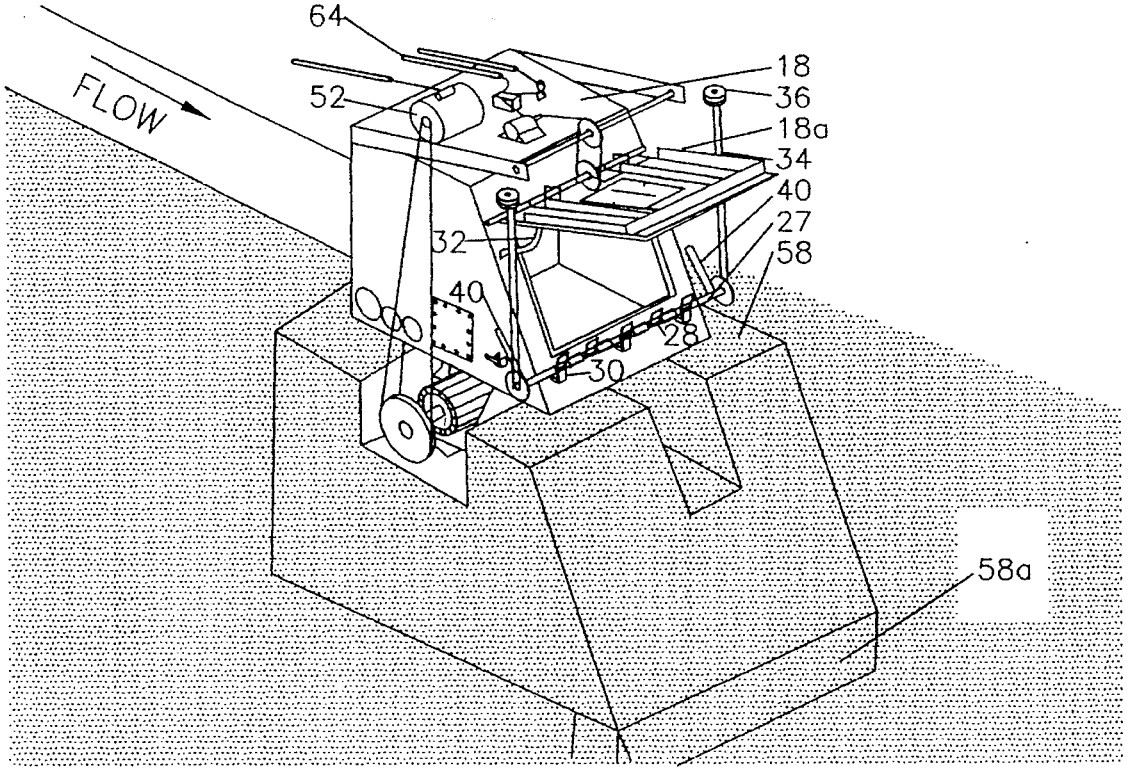
FIG. 3 Shows the Multipurpose Automatic Gate Control device with the gate full open and the lever arms in a vertical position exerting zero torque.
Figure 4:
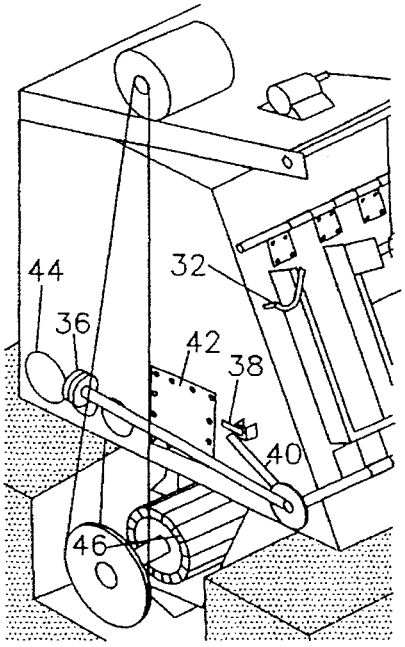
FIG. 4 Shows a typical crossflow turbine, generator, and the spring gate catch.
Figure 7:
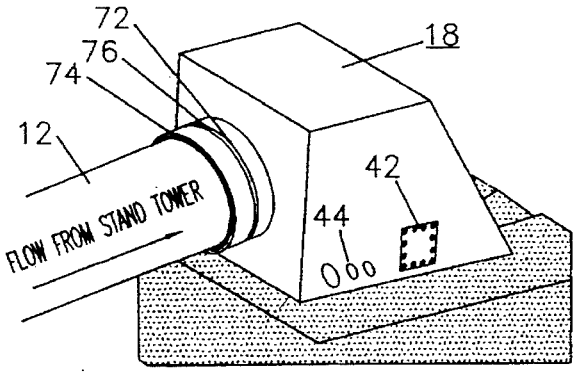
FIG. 7 Shows the collar for attaching the gate control to the outlet pipe.
Figure 8:
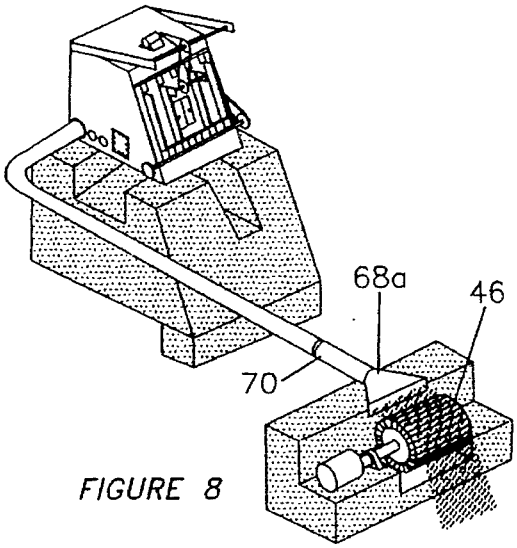
FIG. 8 Shows the alternate installation of a turbine and generator downstream.

FIGS. 2 and 3 provide a view of a heavy foundation 58 and a footing 58*a*, built to withstand the forward thrust. FIG. 7 shows a special collar attachment 72 with a mastic seal 74 and a tension cable clamp 76. These features permit attachment of gate control device 18 to outlet pipe 12. FIG. 8 presents an additional embodiment whereby a crossflow turbine 46 is installed downstream by extending a head pressure water supply line 70 to a location for developing rotational power. A flume 68*a*, modified for cylindrical feed, adapts supply line 70 to turbine 46.

Figure 9:
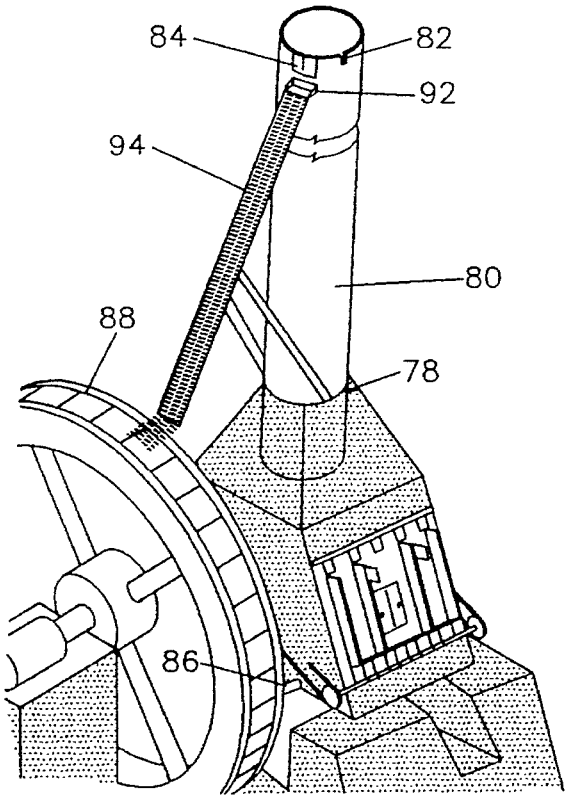
FIG. 9 Shows the gate control installed in a tower mounted on the foundation thus providing additional advantages and adaption to waterwheel.

Another embodiment of this Multipurpose Automatic Gate Control device is presented in FIG. 9. A water tower 80 is mounted on a tower base 78. The tower height should be approximately 1.2 meters (4 feet) above the reservoir level 16. A float control switch 82 is installed at the top of tower 80 and an excess flow and feed aperture 84 provides flow adjustment 92 and outlet for water to a sluice 94. All functions of gate control device 18 are as previously described. Rotational power can also be developed by use of a conventional water wheel 88. Sluice 94 would provide water for an overshot wheel or a feed outlet 86 for an undershot water wheel could be used. A unique feature exists wherein a 20 foot head of water in the reservoir would permit use of a 10 foot diameter water wheel.

Figure 10:
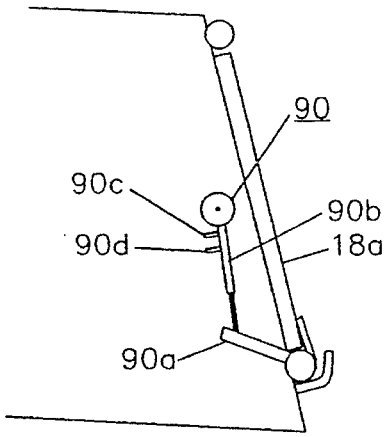
FIG. 10 Shows an alternate means of automatic gate release using a hydraulic cylinder.

FIG. 10 illustrates an embodiment of another method to control the opening of gate 18*a*. Hydraulic release cylinders 90 located on each side of gate control device 18 are pressurized at air inlet valves 90*c* forcing plunger 90*b* down to withstand the rotation of hydraulic toes 90*a* and retain gate 18*a* in a closed position. As hydrostatic pressure increases, due to rising water in the reservoir, the cylinder pressure likewise increases by movement of plunger 90*b* until the pressure release valves 90*d* are activated, thereby allowing gate 18*a* to swing open.

OPERATION

The manner of operating and using this multipurpose automatic gate control device relates to the geographical location and associated weather factors. A large number of these flood control structures are located in the southern region of the United States where agriculture is of great importance. Since rainfall patterns vary, all forms of crops benefit from irrigation. Gravity flow waters are the most economical to use, especially where a supply with head water pressure is available. A typical flood control lake has a surface area of 10 acres to 100 acres. By controlling the outflow and raising the pool level 1.2 meters (4 feet), on an average 25 acre reservoir, a reserve supply of 100 acre feet or 32,670,000 gallons is available for use. If excess rainfall or runoff occurs, the gate 18*a* will automatically open and allow the lake level to drop. The sliding hatch door 20 can be manually opened to drain off average rainfall. During dry weather, the millions of gallons in storage will be slowly drawn down. If necessary, power generation would be curtailed to save water for irrigation.

The operation and use of this multipurpose automatic gate control device involves auxiliary functions that are not part of this invention. These include flood control lakes and other similar reservoirs that have an outlet pipe, agriculture lands below the dam site, aquaculture ponds, greenhouses, use of fish cages in the reservoir, the composting of produce scrap waste, and other functions brought into this method of farming. The integration of these components, with the gate control device serving at center, and the creation of the biological/nutrient cycle to support a self-sustaining farm operation, is the intent and purpose of this gate control device.

The preferred mode of operation, being the use of lever arms and computed counterweights, interacting with the electric winch activated by multiple sensing means, is the most satisfactory for reasons of cost and reliability. Materials for construction for initial installation will be steel. Later models would be made of blow mold plastic composites or of similar materials with the advantage of not rusting. Concrete could be used for the basic structure.

The model with the water tower has a mechanical advantage and provides a means to utilize a water wheel with large diameters for rotational energy. This model would be more costly to install.

From the foregoing detailed description of this invention, it has been shown how the objects of this invention have been attained in a preferred manner. Although the description has many operations and functions, these should not be construed as limiting the scope of this invention, but merely to provide illustration of some of the present preferred embodiments. Modifications in shape, materials, mechanical functions, and equivalents of the disclosed concepts, such as readily occur to those skilled in the art, are intended to be included in the scope of this invention. Thus the scope of this invention should be determined by the appended claims.

The embodiments of this invention in which an exclusive property or privilege is claimed are defined as follows:

1. A multipurpose automatic gate control device structured as a container and mounted over the end of an outlet pipe of a flood control lake or reservoir, and having sufficient exterior surface area to mount a gate release door to the front and other electrical/mechanical components on the sides, all functioning together to provide multiple means for said gate control device to control the storage and release of waters from said flood control lake or reservoir, comprising:

(a) a structural device made of durable materials sufficiently strong to provide a designed means to withstand hydrostatic pressures and deterioration from the elements, (b) said multipurpose automatic gate control device comprising an attachment means consisting of a collar capable of adapting to various size outlet pipes and providing a water seal and release capability, (c) a gate release door mounted on the front of said gate control device hinged on the top edge to automatically swing out and upward as hydrostatic pressures increase overcoming a restraining forces on the bottom edge, said restraining force created by mechanical means comprising a plurality of retaining toes connected by a shaft under torque to a lever arms with weights, said gate release door being of sufficient size so that when it is fully open to permit unrestricted discharge of outflow waters from said outlet pipe, thereby permitting said flood control lake or reservoir to function as designed, (d) said gate release door containing a sliding hatch door for partial release of outflow waters, (e) said gate release door when returned to closed position and retaining force components consisting of the toes connected to the torque shaft and lever arms with weights, allowing water to fill said gate control device, outlet pipe and stand tower, and permitting said flood control lake or reservoir to increase in depth to a predetermined level, creating additional water storage for multiple uses.

2. The multipurpose automatic gate control device as set forth in claim 1, wherein said multiple means comprises: water outlets of various diameters to control outflow for agriculture/aquaculture uses, and outlets with appropriate flow controls to feed a turbine attached to said gate control device.

3. The multipurpose automatic gate control device as set forth in claim 1 having mechanical means to retain said gate in closed position until the water in said flood control lake or reservoir reaches a predetermined level, whereby said gate release door opens automatically, comprising:

(a) two lever arms and computed counterweights mounted externally and transmitting a fulcrum force through a torque shaft mounted on a series of block bearings to a plurality of retaining toes compressed against the bottom edge of said gate release door in closed position, until the rising waters of the reservoir affects an increase in hydrostatic pressure on said gate release door, exceeding the computed fulcrum forces, causing said gate release door to swing upward to full open position, (b) said gate release door when swinging out and upward by the force of discharge waters, engages two spring door catches affixed to said gate control device, and being retained in full open position permitting full discharge from said outlet pipe, whereby the primary function of the flood control lake or reservoir automatically resumes, (c) the computed fulcrum forces created by the lever arms and counterweights, simultaneously decreases as the effective length of the lever arms decrease when rising above the initial horizontal position, thereby assuring the release of said gate release door, (d) a secondary mechanical means to retain said gate release door until the waters reach the predetermined level includes two hydraulic release cylinders mounted on the exterior of said gate control device on opposite sides of said gate release door, with plungers extending downward from the hydraulic release cylinders holding the lever arms in communications with torque shaft and retaining toes, until hydrostatic pressure increases to the predetermined limit, as waters in said flood control lake or reservoir rise, thereby overcoming the compression in said cylinders permitting the torque shaft and toes to rotate away from the base of said gate release door, whereby said gate release door opens automatically.

4. The multipurpose automatic gate control device as set forth in claim 1 with electrical means in combination to open said gate release door when waters in said flood control lake or reservoir reaches a predetermined level, whereby said electrical means are activated simultaneous with said mechanical means, affecting the automatic opening of said gate release door, comprising:

(a) an electric winch and cable attached to said gate release door in conjunction with a series of pulleys for mechanical advantage, (b) a dual means of activating the electric winch to open said gate release door by a response to an increase of hydrostatic pressure inside said gate control device, and by response to an increase in water level at said flood control lake or reservoir, further comprising:

(1) a pressure control switch mounted on said gate control device to respond to the predetermined hydrostatic pressure increase, closing a relay and permitting electrical current to activate said electric winch, the electric current supplied by a battery mounted on said gate control device, (2) a float control switch, external to said gate control device and mounted at a predetermined height above the surface of the reservoir, whereby the rising water closes said float control switch containing a circuit in parallel with said pressure control switch circuit, thereby closing a relay providing a dual means for electric current to activate said electric winch, the electric current source being a second battery mounted on said gate control device, (3) the multiple means for automatically opening said gate release door and the discharge of excess waters, thereby permits said flood control lake or reservoir to continue to fulfill the primary designed purpose of flood control, and after the waters recede, said gate release door is closed and waters are accumulated again for multiple uses.

5. The multipurpose automatic gate control device of claim 1 further comprising:

(a) a turbine, of standard design, mounted on the exterior of said gate control device connected by a flume fed by a stream of water emanating from said gate control device to said turbine, the turbine shaft in communications with means to transfer the rotational forces developed to a generator or for mechanical uses, (b) said gate control device mounted on a foundation base to support said gate control device and a water tower mounted above or adjacent to said gate control device, and in communications with said gate control device, said tower extending upward to a height approximately 1.2 meters (4 feet) above the water level of said flood control lake or reservoir, a float control switch mounted at the predetermined height near the top of said tower, an aperture at reservoir level near the top of said tower to release water down a sluice to a water wheel whereby the rotating shaft of said waterwheel provides transfer of rotational power, (c) a turbine installed at a lower elevation below said gate control device, for gaining additional head pressure, fed by a water supply line from said gate control device, to said turbine for development of rotational forces.

6. A multipurpose automatic gate control device for controlling the storage and release of waters from a flood control lake or similar reservoir, in combination with previously known standard agriculture/aquaculture practices, provides a method to establish a beneficial biological/nutrient cycle comprising:

(a) installing said gate control device on an outlet pipe of said lake or reservoir, with water outlets extending to agriculture plots, aquaculture ponds, greenhouses, and for other purposes, (b) establishing caged fish operations in said reservoir, whereby unconsumed feed and fish excrement fall to the bottom of said reservoir, (c) opening a drain valve on a stand tower in said lake or reservoir, allowing high nutrient bottom reservoir waters to flow by gravity through said gate control device and a series of water outlets to agriculture plots, thereby creating a main link in the biological/nutrient cycle, (d) closing said drain valve on said stand tower, shutting off outlet waters to said agriculture plots, and opening said water outlets on said gate control device to aquaculture ponds, thereby permitting high oxygen waters from the reservoir surface to be fed through said outlet pipe and gate control device to said aquaculture ponds, (e) utilizing the nutrients deposited in said aquaculture ponds, greenhouses, and residue from the processing of fish and other farm products, and applying these nutrients back to the land or converted to animal or fish feed, completes this biological/nutrient cycle, (f) the combined use of all nutrient residue available, and the application back to the land, creates a sustainable farm operation and reduces the degradation of down stream waters.

* * * * *